US005992265A

United States Patent [19]

Klaar

[11] Patent Number: 5,992,265

[45] Date of Patent: Nov. 30, 1999

[54] BUILT-UP CAMSHAFT

[75] Inventor: Roland Klaar, Remscheid, Germany

[73] Assignee: Eisengiesserei Monforts GmbH & Co., Germany

[21] Appl. No.: 08/963,777

[22] Filed: Nov. 4, 1997

[30] Foreign Application Priority Data

Nov. 1, 1996 [DE] Germany ..... 196 45 112

[51] Int. Cl.[6] ..... F16H 53/00

[52] U.S. Cl. ..... 74/567; 123/90.6

[58] Field of Search ..... 74/567, 572, 573 R; 164/58.1; 123/90.6; 29/447, 888.1

[56] References Cited

U.S. PATENT DOCUMENTS

| | | | |
|---|---|---|---|
| 3,689,986 | 9/1972 | Takahashi et al. | 29/527.6 |
| 3,999,277 | 12/1976 | Hamada | 29/447 |
| 4,832,107 | 5/1989 | Hass et al. | 164/98 |
| 4,838,217 | 6/1989 | Ruf et al. | 74/567 |
| 4,927,688 | 5/1990 | Hass et al. | 428/34.6 |
| 5,307,708 | 5/1994 | Matt | 74/567 |
| 5,573,057 | 11/1996 | McDonald | 164/58.1 |
| 5,724,860 | 3/1998 | Sekiguchi | 74/567 |
| 5,737,975 | 4/1998 | Hanisch | 74/567 |
| 5,738,052 | 4/1998 | Meurer | 123/90.6 |
| 5,778,737 | 6/1998 | Welsh | 74/573 R |
| 5,778,841 | 6/1998 | Reedy | 123/90.34 |
| 5,797,180 | 8/1998 | Buchholz | 29/888.1 |

FOREIGN PATENT DOCUMENTS

| | | |
|---|---|---|
| 0 154 787 | 9/1985 | European Pat. Off. . |
| 0 272 471 B1 | 6/1988 | European Pat. Off. . |
| 195 20 306 A1 | 5/1996 | Germany . |
| 61-9959 | 1/1986 | Japan . |
| 1 596 442 | of 0000 | United Kingdom . |
| 1191202 | 5/1970 | United Kingdom . |
| 1596442 | 8/1981 | United Kingdom . |

*Primary Examiner*—Rodney H. Bonck
*Assistant Examiner*—Tisha D. Waddell
*Attorney, Agent, or Firm*—Kennedy Covington Lobdell & Hickman, LLP

[57] ABSTRACT

A built-up camshaft with a shaft body, on which separately produced cams are fixed, is described. In order to achieve that the individual cams can be made with the greatest accuracy and also with concave circumferential areas or running surfaces, and at the same time the shaft body can be balanced in a manner which is optimal from the viewpoint of vibration, a shaft body is provided, which is produced by casting, forging or the like. Except for the cams, all functional elements, such as sprocket mountings, axial bearings and position transmitters, can be formed in one piece on the shaft body during its manufacture.

2 Claims, 2 Drawing Sheets

BUILT-UP CAMSHAFT

FIELD OF THE INVENTION

The invention relates to a built-up camshaft, in particular for internal combustion engines, with a shaft body on which separately produced cams are fixed.

BACKGROUND OF THE INVENTION

Built-up camshafts, for example with a steel tube as the shaft body, can have various installed or attached parts, namely cams, sprocket mountings, sprockets, axial bearings, axial bearing shoulders, and signal emitters, or the like.

A camshaft is called "built-up" when the shaft body and the cams have been produced separately and wherein the essentially finished cams are fixed on the shaft body, for example by pushing them on. Such built-up camshafts and their assembly are described in German Patent Publications DE 41 21 951 C1 and DE 195 20 306 A1. Within the prior art there are also one-piece camshafts, i.e. with cams shaped integrally on the shafts, which can be cast of iron, for example. The camshafts can also be produced as hollow bodies. Reference is made in this connection to British Letters Patents GB 1 596 442 and GB 1 191 202, Japanese Patent Publication JP-A-619 959 and European Patent Publications EP 0 154 787 B1 and EP 0 272 471 B1. As a rule, cast camshafts are produced in such a way that the cams and other functional elements are cast integrally with the shaft in one piece.

In modern internal combustion engines, for which the camshafts herein described are preferably employed, levers with attached small rollers are actuated with the aid of the cams and not, as was previously done, by straight tappets. The rollers run on the cams. Cams are required for this which not only must be worked very accurately (accuracy at an order of magnitude of micrometers), but which require at least one concave area at the circumference for reasons of the kinematics of the lever linkage. In this connection a "concave" area identifies a cam circumference section with a radius of the cam which is reduced and then again increases via two geometric reversing points. The lever roller runs over the concave circumferential section like a car wheel over a bump. The concave circumferential area should of course also be worked as accurately as the remaining portions of the cam circumference. The present invention is recognition that these prescribed accuracies can only be achieved with economically justifiable means by separately manufactured cams, for example by sintering. If lever linkages are to be actuated by cams, practically only built-up camshafts can be considered.

In actuality camshafts for internal combustion engines are already balanced for vibrational reasons by shaping the shaft, so that at all possible rpm there is optimal quiet running. Such balancing really is out of the question with a built-up camshaft, for example based on a steel tube, since it is not possible to balance a steel tube with economically and safety-wise justifiable means, together with the micrometer accuracy demanded at the same time. Such optimally balanced camshafts are commercially available only in cast iron. But with these camshafts the cams themselves cannot be worked with the accuracy demanded by modern technology as mentioned above.

SUMMARY OF THE INVENTION

It is the object of the invention to produce a camshaft whose cams can be accurately worked (prior to assembly) the same as a built-up camshaft and whose shaft bodies can be shaped in accordance with the balancing requirements the same as a cast camshaft.

This object is attained in connection with a built-up camshaft with a shaft body on which separately produced cams can be fixed, by a cast shaft body. Within the scope of the invention, however, the shaft body can alternatively also be produced by forging, among other ways.

Accordingly, by means of the invention a cast, forged, or other manufactured camshaft for receiving a multitude of cam elements is created for producing an assembled or built-up camshaft. In further accordance with the invention, this camshaft integrally includes other functional elements, with the exception of the actual cams, such as sprocket mountings, axial bearings and position transmitters in accordance with their manufacture or as one piece as a fixed component of the cast body, forged body or the like. With the exception of the actual cams, the other functional elements should be formed in one piece with the shaft body during the production of the shaft.

With the camshaft in accordance with the invention there is less emphasis on the type of manufacture (casting, forging or the like), than on the result of the manufacture. The shaft should be embodied in such a way as if it had been cast. For simplicity's sake therefore often only a cast camshaft is referred to in what follows.

Because in accordance with the invention a shaft body "cast" in one piece, including the said further functional elements, is used, the special work for applying or fixing the said further functional elements, such as sprocket mountings, axial bearings and position transmitters, required in connection with conventionally (built-up on a steel tube) built camshafts, can surprisingly be essentially omitted. These elements only require retouching work of less accuracy than the cams during the shaping of the shaft body.

The combination in accordance with the invention of the production steps of conventionally manufactured camshafts and conventionally cast camshafts therefore brings the unexpected technical and economical advantage that the cams, which must be worked in a highly accurate manner, can be separately produced, and the remaining functional elements, which need to be worked less accurately, can be produced together with the shaft body. By means of this it is possible to produce a camshaft which is as precise as a built-up camshaft with approximately the same outlay as for an entirely cast camshaft.

A decisive advantage of the invention lies in that the shaft body can initially be shaped in a manner optimally balanced in respect to vibration during its production. In accordance with the further invention it is advantageously possible to contour the shaft during production (casting, forging, etc.) in accordance with predetermined balancing requirements.

Solid as well as hollow shaft bodies are possible within the scope of the invention. The shaft bodies of camshafts can be cast, for example in accordance with the aforementioned European Patent Publication EP 0 272 471 B1, with a continuous bore by using glass bodies, with blind bores and/or an interior hollow chamber. It is within the scope of the invention to directly create predetermined contouring on the inside of the shaft during casting of the respective hollow chambers, so that during this first production process the shaft is initially essentially balanced in accordance with the predetermined requirements regarding vibration. In still further accordance with the invention and in addition to or in place of this interior contouring, an exterior contouring is possible, in particular also for the purpose of balancing.

Within the scope of the present invention, the shaft body can be made of a metallic or non-metallic material, in particular of iron-carbon material, of alloyed or non-alloyed iron, of laminated or nodular graphite cast iron or steel, as well as of injection-molded or the like materials which can be employed in the engine compartment of internal combustion engines. In a narrower sense, the invention relates only to the shaft body, produced in one piece with the required functional elements in addition to the cams, and balanced, if required, but without cams which must be accurately finished. The individually produced cams themselves can be fixed on the shaft body in accordance with known joining processes (see the above mentioned German Patent Publications DE 41 21 951 C1 and DE 195 20 306 A1) following the essentially complete pre-finishing.

Details of the invention will be explained by means of the schematic representation of exemplary embodiments.

DESCRIPTION OF THE PREFERRED EMBODIMENT

Figure 1:
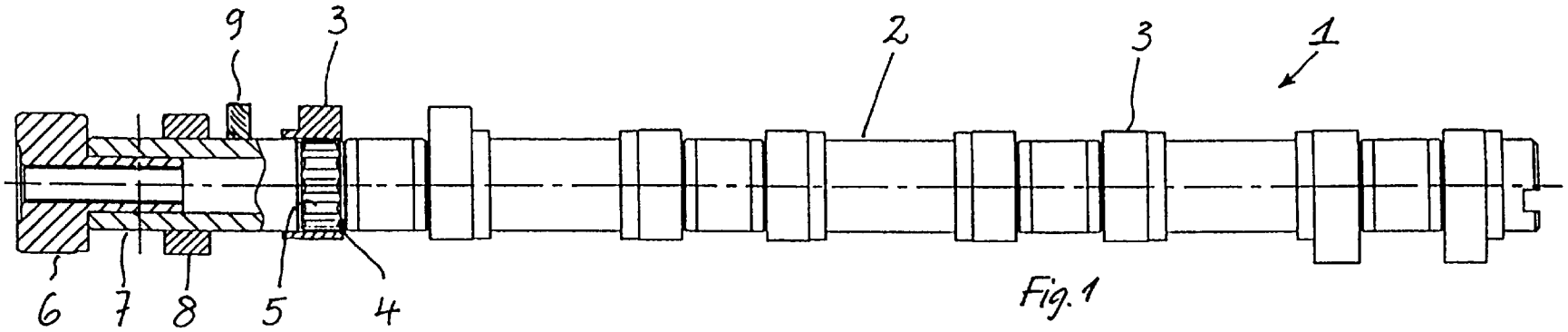
FIG. 1 is a side view of a conventional built-up camshaft, partially in section.

FIG. 1 shows a conventional built-up camshaft 1 with a shaft body 2, on which separately manufactured cams 3 are fixed. Corrugated clamping sleeves 5, which are inserted into a collar 4 of the shaft body 2, can be used for fixing the individual cams 3. Generally, it is necessary for completing the cam shaft 1 to fix a hub or a sprocket mounting 6, an axial bearing 7 with a shoulder 8 and in most cases also an asymmetric position transmitter 9 (for detecting the dead center position of the first cylinder) on the shaft body which, in accordance with FIG. 1, preferably should be made from a steel tube. The mounting 6 and/or the shoulder 8 themselves can also be embodied as sprockets. The elements 6 to 9 must be separately produced for completing a conventionally built-up camshaft 1 in accordance with FIG. 1.

Figure 2:
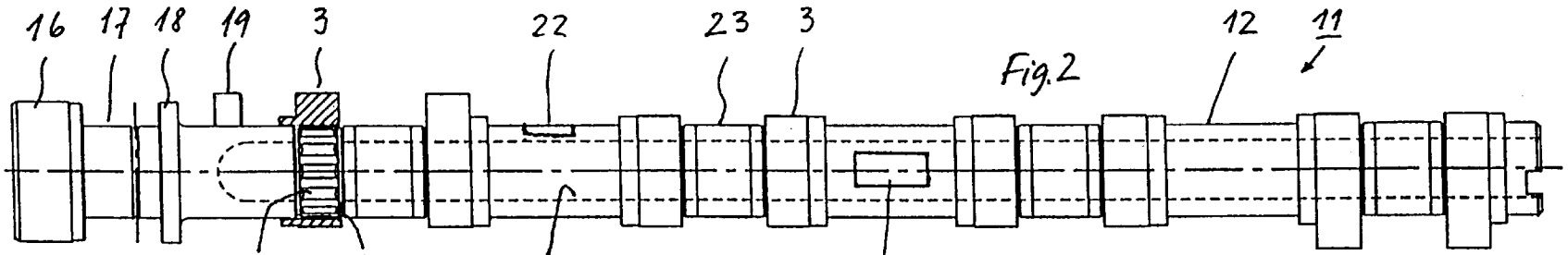
FIG. 2 is a side view of a built-up camshaft according to the preferred embodiment of the present invention and having a closed shaft body.
Figure 3:
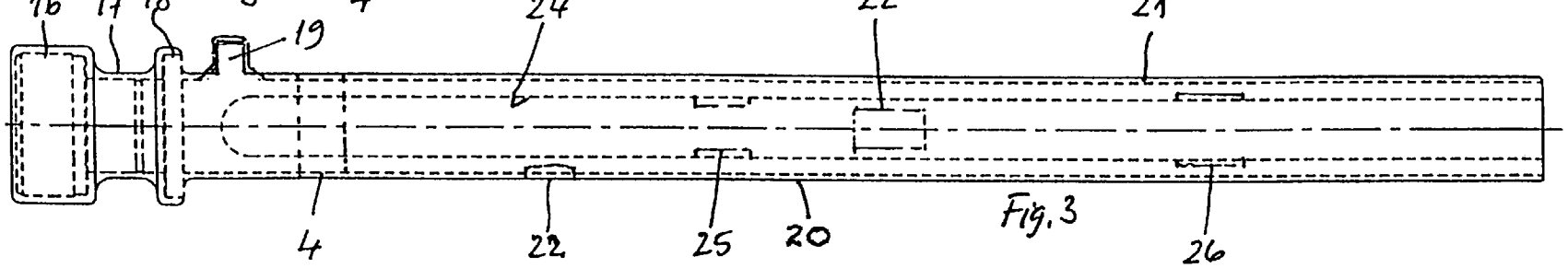
FIG. 3 is a side view of the cast unfinished part of the shaft body of FIG. 2.

The exterior of the camshaft in accordance with the present invention, identified as a whole by 11 in FIGS. 2 and 3, with a shaft body 12 made of cast iron, looks essentially the same as the wholly built-up camshaft 1 in accordance with FIG. 1. In particular, it is possible to apply the cam 3 with the collar 4 and the clamping sleeve 5 practically in the same way as in accordance with FIG. 1. However, an essential difference lies in that the mounting 16, the axial bearing 17, the shoulder 18 and the (asymmetric) signal transmitter 19 are formed integrally in one piece with the shaft body 11 during the manufacture of the unfinished body 20 in accordance with FIG. 3. The surface of the unfinished cast body 20 should of course be worked prior to further processing, in particular prior to attaching the cams 3; for example, an outer layer 21 can be removed, so that the contour in accordance with FIG. 2 is created. In the course of removing the outer layer 21 it is also possible to create the collars 4 at the positions provided for the cams 3.

An essential advantage of the camshaft in accordance with the present invention consists in that it is possible to fabricate the shaft body 12 initially in its form as an unfinished body (FIG. 3) by casting (if necessary also by forging, etc.) in a manner in which it is optimally balanced from the viewpoint of vibration. In this sense it is already possible during casting to contour the exterior surface with recesses 22 as defined places on the surface of the unfinished body 20. For example, the shaft body 12 can have an oval, rectangular or the like non-circular cross section in the area between respectively two cams 3, where no bearings 23 are required, in order to achieve the desired balance. The deformation for the purpose of balancing should take place in such a way that the attachment of the cams 3 is not hindered. For this reason projections on the exterior surface are not generally permissible.

However, in accordance with the present invention it is also or additionally possible to achieve the balance obtained by the described contouring of the exterior surface of the shaft body by means of an appropriate contouring of the interior surface of a hollow cast (or made hollow in another way) camshaft. If, for example, a hollow chamber 24 in accordance with FIGS. 2 or 3 is formed inside the cast shaft body 12 or the unfinished body 20, for example by the insertion of a core of a quartz material, it is possible with the appropriate shaping of the core to provide contouring with projections 25 or recesses 26 on the interior surface during casting in such a way that the shaft is initially balanced as an unfinished body in accordance with predetermined, i.e. calculated values.

Figure 4:
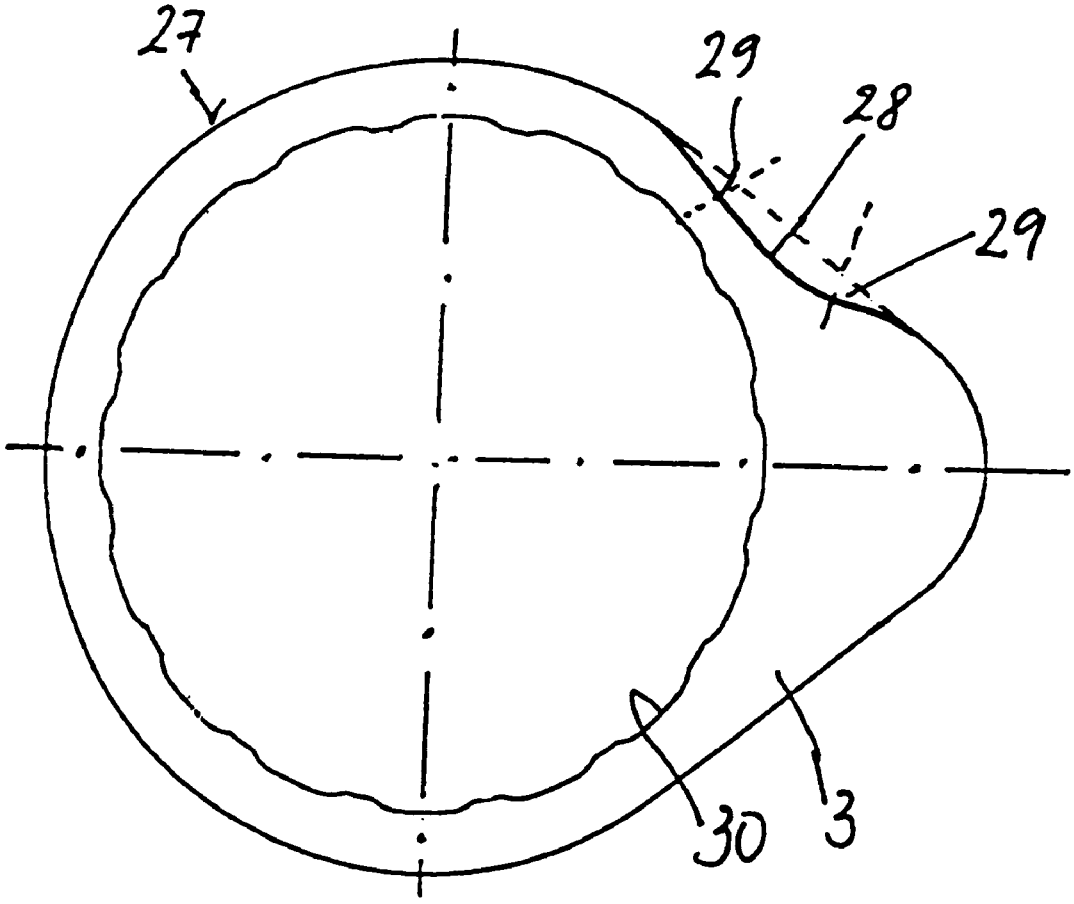
FIG. 4 is an end view of one of the cams mounted on the camshaft of FIG. 2.

As an example, FIG. 4 represents the cross section of a cam 3 which, in accordance with the present invention, is to be fastened on the shaft body 12 and which has a concave area 28 with two reversing points 29 over a portion of its running surface, i.e. its circumference 27. Incidentally, it is possible to provide the inner surface 30 of the cam 3 with a corrugated profile matching the corrugated profile of the clamping sleeve 5 (FIGS. 1 and 2).

A built-up camshaft with a shaft body, on which separately produced cams are fixed, is described. In order to achieve that the individual cams can be made with the greatest accuracy and also with concave circumferential areas or running surfaces, and at the same time the shaft body can be balanced in a manner which is optimal from the viewpoint of vibration, a shaft body is provided, which is produced by casting, forging or the like. Except for the cams, all functional elements, such as sprocket mountings, axial bearings and position transmitters, can be formed in one piece on the shaft body during its manufacture.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A built-up camshaft, for internal combustion engines, comprising:

a cast iron shaft body;

sprocket mountings, axial bearings with shoulders and position transmitters, all said sprocket mountings, axial bearings with shoulders and position transmitters being cast integrally with said shaft body; and separately produced cams mounted on said shaft body.

2. A built-up camshaft, for internal combustion engines, comprising:

a cast iron shaft body having cast integrally therewith at least one functional part in the form of a sprocket mounting, axial bearing with shoulders and position transmitter; and separately produced cams mounted on said shaft body.

* * * * *